United States Patent [19]

Meister et al.

[11] 4,183,005

[45] Jan. 8, 1980

[54] CIRCUIT INTERRUPTING DEVICE

[75] Inventors: Otto Meister, Arlington Heights; Thomas J. Tobin, Northbrook, both of Ill.

[73] Assignee: S&C Electric Company, Chicago, Ill.

[21] Appl. No.: 909,145

[22] Filed: May 24, 1978

[51] Int. Cl.[2] ..... H01H 85/38

[52] U.S. Cl. ..... 337/275; 200/61.08; 200/150 R

[58] Field of Search ..... 337/273–275, 337/281, 277; 200/150 R, 145, 61.08

[56] References Cited

U.S. PATENT DOCUMENTS

| | | | |
|---|---|---|---|
| 2,112,841 | 4/1938 | Hill | 337/280 |
| 2,571,735 | 10/1951 | Lindell | 337/275 |

*Primary Examiner*—R. L. Moses

*Attorney, Agent, or Firm*—John D. Kaufmann

[57] ABSTRACT

An improved circuit interrupting device includes a pair of relatively movable contacts between which an arc is established. As the contacts are moved apart to elongate the arc, a container of pressurized dielectric fluid directs a flow of the fluid from a port at the arc. The fluid and arc elongation ultimately extinguish the arc. A diaphragm which normally closes the port to prevent fluid flow is normally mechanically attached to one of the contacts. When the contacts are moved apart, the container and the one contact also move apart tearing or cutting open the diaphragm to permit the fluid to flow at the arc. Both relative contact movement and the relative movement of the container and the one contact are effected by the action of the ignition products of a power cartridge on a piston-cylinder.

61 Claims, 16 Drawing Figures

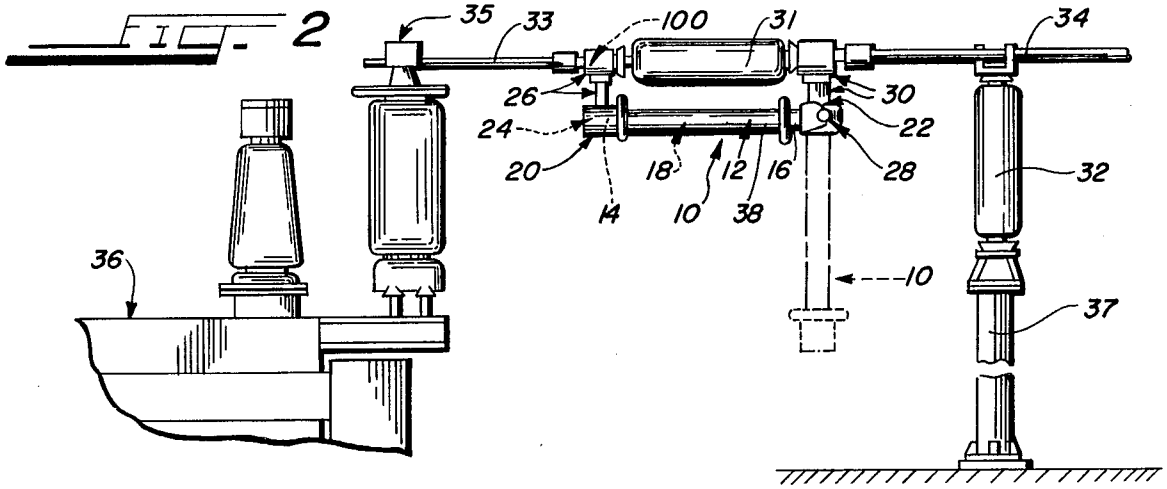
FIG. 2
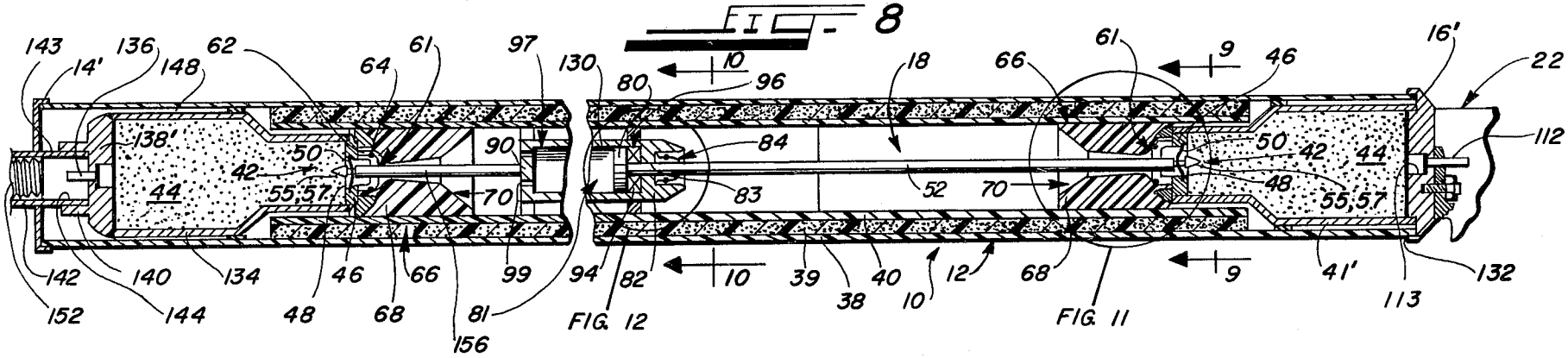
FIG. 11
FIG. 12
FIG. 8

CIRCUIT INTERRUPTING DEVICE

BACKGROUND OF THE INVENTION

1. Field of the Invention

The present invention relates to an improved circuit interrupting device, and, more particularly, to an improved, high voltage, fuse-like circuit interrupting device which utilizes relatively movable contacts and pressurized dielectric fluid to extinguish an arc incident to circuit interruption.

2. Description of the Prior Art

Various alternating current circuit interrupting devices are well known, including fuses, circuit breakers, reclosers, circuit switchers, and the like. The present invention relates to fuses or fuse-like devices, as opposed to other types of interrupting devices.

In general, high voltage fuses utilizing a movable contact, often termed an "arcing rod", are well known. Typically, as the arcing rod moves, an arc is established between the arcing rod and a stationary contact. Such fuses normally contain a solid arc-extinguishing material (often referred to as an "ablative material") such as boric acid, cellulose "horn" fiber or the like. Interaction of the elongating arc with the solid arc-extinguishing material generates large quantities of high dielectric strength arc-extinguishing gas which deionizes, cools and causes turbulence in the region occupied by the arc. These effects of the gas, in combination with the elongation of the arc as the arcing rod moves away from the stationary contact, extinguish the arc at a subsequent current zero. Typically, arcing rod movement is effected by a stored energy operator, such as a spring.

While prior art fuses of the type generally described above have been made to work well at 69 kV and below, when adapted for use at higher voltages, say 115 kV or higher, they become quite expensive and may operate inconsistently from fuse to fuse. Moreover, many prior art fuses are quite complicated and expensive, and many of the chemicals used as solid arc-extinguishing materials have recently become prohibitively priced or of uncertain availability.

Various prior art patents disclose fuses or fuse-like devices which are species of the fuses described above in general terms. This species of fuse utilizes movable contacts, stationary contacts, and various arc-extinguishing materials. The following patents disclose fuses in which a pressurized fluid is used as an arc-extinguishing medium, usually in addition to an ablative arc-extinguishing material: Ackermann U.S. Pat. No. 3,265,838; Link U.S. Pat. No. 3,771,089; Rawlins U.S. Pat. No. 2,343,422; McCloud U.S. Pat. No. 3,032,630; Frink U.S. Pat. No. 3,268,690; and Triplett U.S. Pat. No. 2,319,277 (commonly assigned herewith). Although the fuses of these patents vary in their specific details of construction, they share many structural and functional features. Generally speaking, the fluid is retained in a reservoir by a massive stopper or plug. Connected in electrical series with the stopper is a fusible element, which is also connected to a stationary contact. A movable contact or arcing rod is prevented from moving away from the stationary contact by the presence of the fusible element. The arcing rod may be hollow and communicate with, or may constitute, the reservoir. Movement of the arcing rod is effected by a spring or by the jet action of the fluid escaping from the reservoir.

When an overcurrent melts the fusible element, the arcing rod is released for movement. Also, when the fusible element melts, an arc is established either between the stationary contact and the stopper, or in the vicinity of the stopper. The arc either burns a hole through the stopper or its heat melts the stopper, to release the fluid. Arc elongation, due to arcing rod movement, and fluid flow extinguish the arc.

The above-described devices have at least three inexpedient characteristics. First, the fusible elements and the stoppers are in electrical series and both must carry the normal, continuous current flowing through the devices. As a consequence, different stoppers (i.e., different as to size, thickness and material), as well as different fusible elements, must be used at different current ratings of the devices. Accordingly, both the fusible element and the stopper determine the time-current characteristics of the fuses. Second, the stopper is burned through and melted only after the arc is established. The establishment of the arc is preceded by the melting of the fusible element. Thus, the resultant arc, and not the overcurrent per se, burns through and melts the stopper. As a consequence, the devices are somewhat slow to operate due to the time it takes for the sequential occurrence of the melting of the fusible element, the establishment of the arc, and the burning through by the arc of the stopper. Third, the stopper is rather massive (to resist both the melting effect of normal current and the force exerted by the pressurized fluid) and requires substantial energy to be melted.

Even more importantly, the repeatability and consistency (from sample-to-sample) and the predictability of operation of all of the above prior art devices are doubtful. In addition to the previously-noted deficiencies, when a fusible element is in electrical series with a stopper through which an arc must burn a hole, the repeatable formation from sample-to-sample of a sufficiently large hole cannot be assured. Specifically, if a number of similar prior art devices were to be subjected to similar normal and fault conditions, arc-burned holes having various sizes, shapes and locations would be produced, due primarily to the evanescent nature of arcs and the inability to predict just where they may "root". Ackermann notes that "the opening [i.e., the hole] . . . may under certain conditions be too small to overcome by ['jet action'] the forces which hold the capsule [i.e., cartridge] . . . in place." Additionally, such variations in hole formation may be exacerbated by the variable heating effects on the stoppers caused by the variable normal currents they continuously carry. Moreover, the use of stoppers, through which the arc is expected to burn a hole, to carry normal current in series with a fusible element limits the choice of ampere ratings and time-current curves severely, leading, as noted by Ackermann, to the use of different arc-burned-through stoppers at different continuous and interrupting current ratings of the devices.

Commonly-assigned, co-pending, commonly-filed U.S. patent applications Ser. No. 904144 , filed May 24, 1978 discloses a device which represents an improvement over the type of device described above. There, a thin fusible diaphragm reliably and predictably melts to permit pressurized dielectric fluid flow from a normally closed reservoir and to release an arcing rod normally restrained by the diaphragm to the action of a spring. Most of the current flowing through the device is normally shunted away from the diaphragm by a fusible element, thus permitting the diaphragm to assume sufficient thinness to assure its reliable melting. When the fusible element melts, all of the current flowing through the device is instantaneously directed through the diaphragm to melt it. The fluid flow and elongation of an arc struck between the moving arcing rod and a stationary contact extinguish the arc.

Five commonly-assigned U.S. Pat. Nos. 2,571,735 (to Lindell); 2,517,624 (to Baker); 2,353,528; 2,319,277 (FIG. 12); and 2,319,276 (all to Triplett) relate to fuses in which a compressed dielectric fluid flows from a cartridge to aid in arc-extinguishment. Specifically, these patents disclose power fuses in which a spring-driven arcing rod moves away from a stationary contact following the melting of a fusible-element-strain-wire combination due to an overcurrent through the fuse. The movement of the arcing rod is effective to cause a pin or lance to move against the outside of, and to puncture, a seal closing the cartridge. An arc struck between the moving arcing rod and the stationary contact is extinguished by the combined action of the fluid from the cartridge, a gas evolved from a solid arc-extinguishing material with which the arc interacts, and arc elongation.

At first glance, the devices of these five patents might seem to eliminate one of the major disadvantages of the prior art devices utilizing a fusible stopper. Specifically, puncturing of a seal may appear to offer more reliable and predictable formation of a sufficiently large hole in the seal to ensure an instantaneous flow of fluid in large quantity. However, the entry of the pin into the seal from the outside thereof in part blocks the hole so formed, interfering with fluid flow. Hollow pins used to alleviate this shortcoming also block the hole, there being limitations on the size of passageways in the pins due to the limited amount of space available in the fuse. Also, experience has shown that the pins—solid or hollow—often fail to puncture the seal due to the limited amount of driving force available from realistic springs.

In most of the prior art devices where pressurized dielectric gas or fluid has been used, the gas or fluid is specifically effective only for the interruption of low fault currents. This is emphasized by the presence in the Ackermann, Baker, Frink, Lindell, Link, Rawlins and Triplett (all three) patents of both contained pressurized fluid and a solid or ablative arc-extinguishing material, interaction of which with the arc produces (in addition to the fluid) arc-extinguishing gas which is primarily effective at high fault current levels.

Accordingly, an overall object of the present invention is to obviate the above-noted problems inherent in the above-noted prior art devices.

A further object of the present invention is the provision of a fuse-like current interrupting device which (a) is simple, inexpensive to manufacture and predictably reliable in operation;

(b) works reliably above 69 kV;

(c) does not require an ablative arc-extinguishing material;

(d) does not rely on the burning or melting of a hole to release an arc-extinguishing fluid; and (e) avoids blockage of a hole formed in a seal by puncturing thereof.

SUMMARY OF THE INVENTION

With these and other objects in view, an improved circuit interrupting device in accordance with the present invention includes a pair of relatively movable contacts. A reservoir of pressurized dielectric fluid has a port normally closed by a diaphragm. The contacts and the diaphragm cooperate so that relative movement of the contacts apart tears or rips the diaphragm to permit the fluid to flow from the port. The fluid is directed at an elongating arc established between the contacts. The fluid and the elongation extinguish the arc. The diaphragm is torn or ripped by a tearing or ripping force applied thereto in the same direction the fluid flows from the port, thus avoiding blockage of the port.

In various preferred embodiments, one of the contacts is on the reservoir. The diaphragm is torn by a mechanical attachment between the diaphragm and the other contact; relative parting movement of the contacts also moves the diaphragm and the other contact apart, tearing the diaphragm open. The contacts are moved apart by a piston-cylinder, which is preferably actuated by ignition of a power cartridge.

As used herein, the word "tear" or "rip" contemplates the tearing, ripping, cutting, slicing, incising, rupturing or the like of the diaphragm. As noted, a tearing or ripping force is applied to the diaphragm in the same general direction as taken by the fluid flowing from the port. The tearing or ripping force may be effected by the diaphragm being pulled in this specified direction against facilities outside the reservoir which cut the diaphragm. The tearing or ripping force may also be effected by the pulling of facilities within the reservoir against the diaphragm in this specified direction until the diaphragm tears or rips. Lastly, the tearing or ripping force may be applied simply by pulling on the diaphragm in the specified direction until it tears or rips.

"Tearing" or "ripping" of the diaphragm also contemplates removal of some, all or none of the diaphragm. Specifically, application of the tearing or ripping force may remove a piece of, or the entire, diaphragm. Such removal is in the direction taken by the fluid flowing from the port. If any of the diaphragm remains in the port, it is moved out of the fluid flow by the fluid flowing therepast, by the tearing or ripping force or by both of these. Alternatively, the tearing or ripping force may merely slice through the diaphragm to form one or more openings therethrough from which the fluid may flow. Portions of the diaphragm between the openings are moved out of the fluid flow by the fluid flowing therepast, by the tearing or ripping force, or by both of these.

This manner of tearing or ripping the diaphragm, and of moving any remaining portions thereof out of the fluid flow, avoids blockage of the port to maximize the effects of the fluid in extinguishing the arc.

BRIEF DESCRIPTION OF THE DRAWINGS

FIG. 2 is another general view of a circuit interrupting device according to the present invention, the device being horizontally mounted for dropdown operation;

FIG. 8 is a partially-sectioned, side view of a two-gap circuit interrupting device according to the principles of the present invention and usable as shown in FIGS. 1 and 2;

FIGS. 11 and 6 are alternatively usable in the devices of FIGS. 3 and 8;

DETAILED DESCRIPTION

Figure 1:
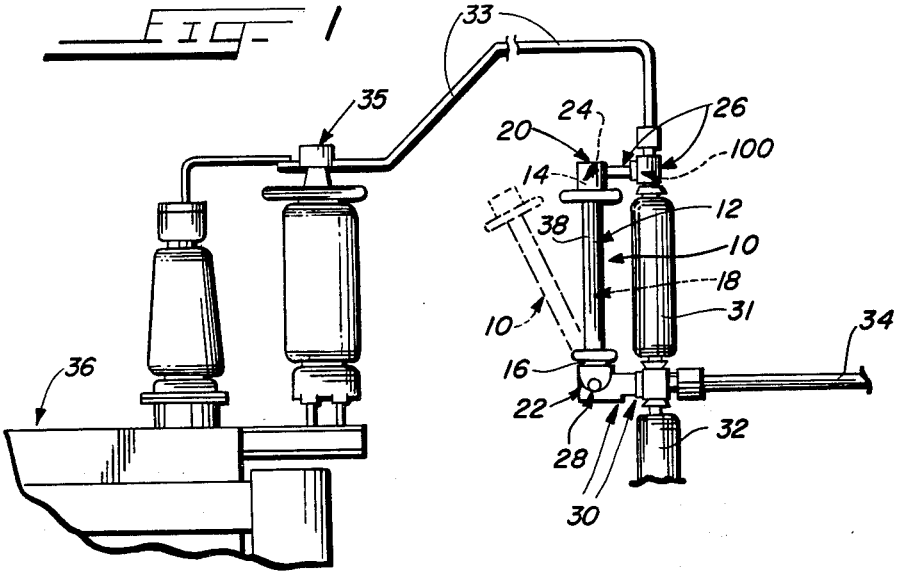
FIG. 1 is a general view of a circuit interrupting device according to the present invention, the device being used to protect a transformer and being vertically mounted for dropout operation.
Figure 4:
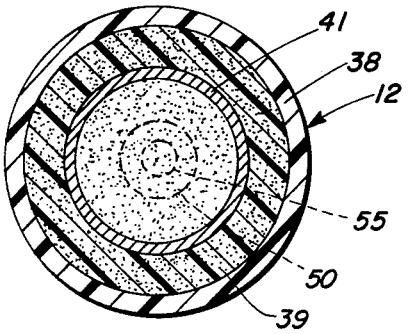
FIGS. 4 and 5 are sectional views, taken respectively along lines 4—4 and 5—5 of FIG. 3 showing in greater detail various aspects of the device of the present invention.
Figure 5:
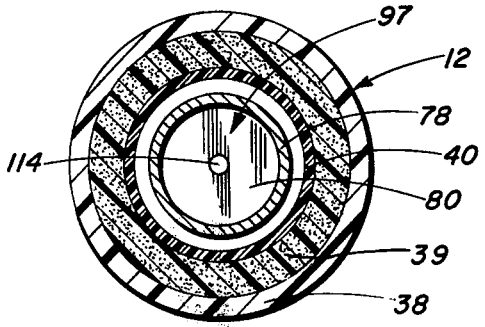
Figure 3:
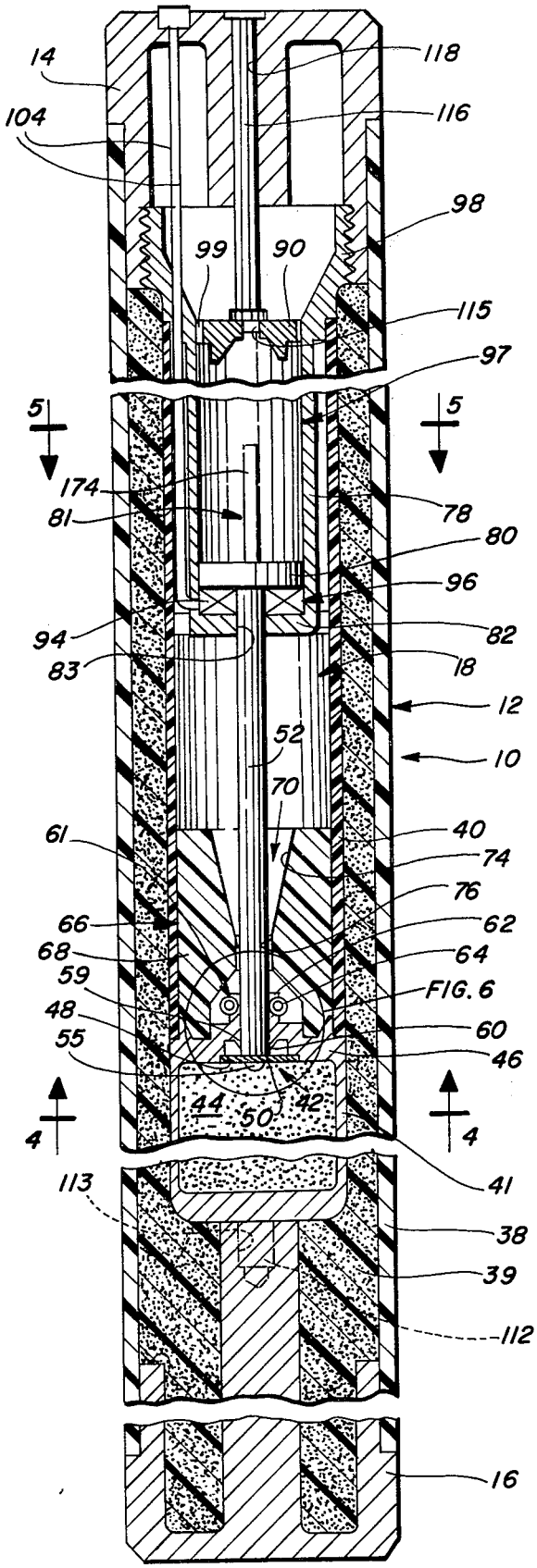
FIG. 3 is a partially sectioned, side view of a single gap circuit interrupting device usable as shown in FIGS. 1 and 2.

General—FIGS. 1, 2 and 3

A fuse-like circuit interrupting device 10 in accordance with the principles of the present invention is generally depicted in FIG. 1. FIG. 1 shows the device 10 in a so-called vertical, dropout configuration wherein following operation of the device 10 to interrupt a circuit, the device 10 drops out from its normal vertical position, as shown in solid lines, to a position rotated therefrom as shown by the dotted lines. In FIG. 2, a similar device 10 is shown in a so-called horizontal dropdown configuration wherein following operation, the device 10 drops down to the position shown in dotted lines. It is not necessary that the device 10 be used in either the dropout or dropdown configuration. It may also be used in any orientation in a non-dropout or non-dropdown configuration.

Referring to FIGS. 1, 2 and 3, the device 10 includes an outer insulative housing 12 carrying a pair of circuit-connectable terminals or metallic conductive end ferrules 14 nd 16 on opposed ends thereof. Although the end ferrules 14 and 16 may take numerous specific forms and constructions, various ones of which are shown in the Figures, the reference numerals 14 and 16 are used universally therefore, as they form no crucial part of the present invention. An interrupting unit 18 contained within the housing 12 performs a circuit interrupting function described in more detail below.

The end ferrules 14 and 16 may respectively mount end fittings 20 and 22. One end fitting 20 includes a latch 24 which normally engages a first mounting or latch mechanism 26 for maintaining the device 10 in its normal vertical (FIG. 1) or horizontal (FIG. 2) orientation. The other end fitting 22 includes a hinge 28 which is engaged by a second mounting or hinge mechanism 30. The cooperation of the hinge 28 and the hinge mechanism 30 permit rotation of the interrupting device 10 when the latch 24 is operated so as to release the latch mechanism 26. The end fittings 20 and 22, the latch 24, the latch mechanism 26, the hinge 28 and the hinge mechanism 30 may take any convenient form known to those skilled in the art and form no crucial part of the present invention. Moreover, as is well-known, the latch 24 may be operated to permit device 10 rotation either by operation of the device 10 or by manipulation of a pull ring (not shown) on the end fitting 20 with a hook stick (not shown) The end fittings 20 and 22 are selectively attachable to opposed circuit points, represented in FIGS. 1 and 2 by the latch mechanism 26 and the hinge mechanism 30, to which circuit points the interrupting device 10 is connected.

As noted, the device 10 need not be used in a dropout or dropdown configuration, but may be used in a non-dropout or non-dropdown mode. In this event, the housing 12 may include a series of leakage-distance increasing skirts (not shown), as is well known.

The latch mechanism 26 and the hinge mechanism 30 may be maintained apart in a fixed insulated relationship by one or more insulators 31. The insulator 31 and the mechanisms 26 and 30 may, in turn, be supported by an insulator stack 32 or the like (FIG. 1) with respective buses 33 and 34 being connected to the mechanisms 26 and 30 in any appropriate manner. The bus 33 may be connected to a bushing 35 of a transformer 36 protected by the device 10. The bus 34 is connected to a power source (not shown). As shown in FIG. 2, the device 10 may also be mounted directly in the buses 33 and 34 feeding the transformer 36, in which case the insulator stack 32 may support one bus 34, with the other bus 33 supported by the bushing 35. Thus, the device 10 may be either bus-mounted (FIG. 2) or may be more conventionally mounted (FIG. 1). In either event, the insulator stacks 32 may be mounted by a ground-supported column 37 or the like. If the device 10 is used in a non-dropout or non-dropdown fashion, it may be directly connected into the buses 33 and 34 by any of well-known mounting facilities.

Referring to FIG. 3, the insulative housing 12 may comprise an outer layer or skin 38 of a weather-resistant, insulative material, including any well-known plastic or polymer. Inside the skin 38 may be a generally cylindrical dielectric body 39 made of a high dielectric strength, low electrical permittivity material, which may be a foam. The body 39 may be selected to grade voltage stresses appearing on the outside of the housing 12 following operation of the device 10. Yet another insulative cylinder 40 may be within the dielectric body 39. The insulative cylinder 40, which may be glass-reinforced epoxy, adds internal structural strength and integrity to the device 10, especially where the body 39 is foam. The end ferrules 14 and 16 are mounted in any convenient manner to the housing 12 so that they close, and seal the open ends of the housing 12.

Interrupting Unit 18—First Embodiment—FIGS. 3, 6, 7, 11, 12 and 14

Figure 7:
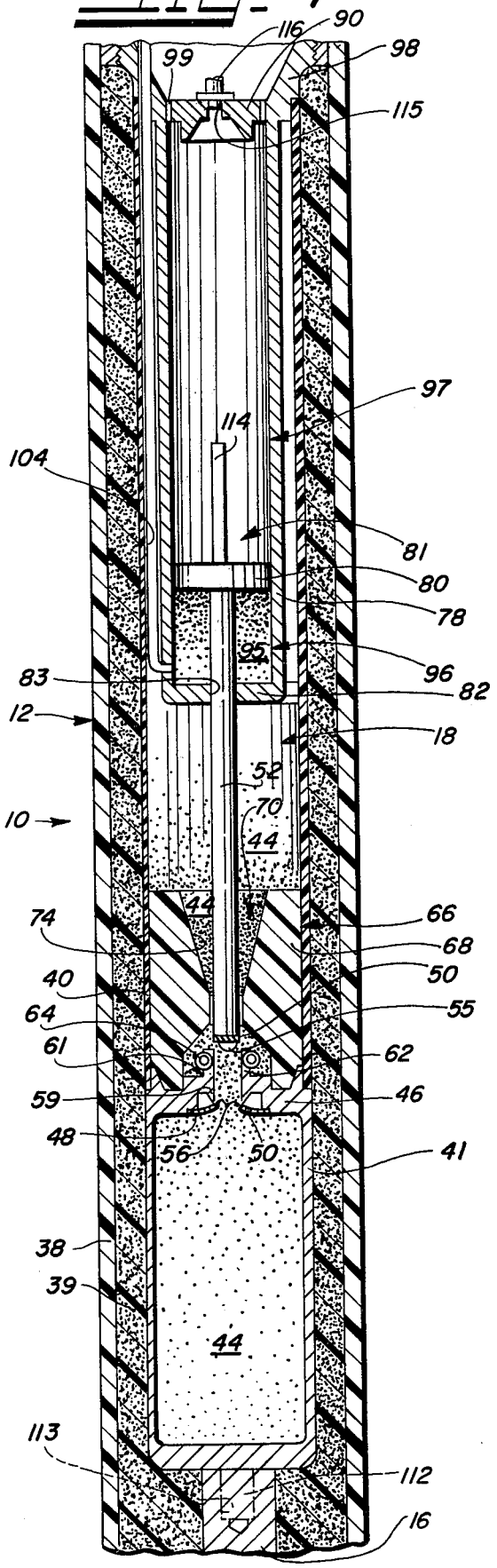
FIG. 7 is a view similar to FIG. 2, showing the device of the present invention during operation thereof.

FIGS. 3 and 7 depict a first embodiment of the circuit interrupting device 10 of the present invention in which the interrupting unit 18 opens a single gap.

Within the housing 12 at one end thereof is a fluid reservoir 41, which may be canister, container, cylinder, cartridge or the like. Preferably, the reservoir 41 or a portion thereof is electrically conductive. Specifically, the reservoir 41 may be made entirely of metal as depicted in the Figures, or may alternatively comprise a non-conductive cylinder (not shown) of a ceramic or the like which is (1) wholly or partially surrounded by an electrically conductive member (not shown) such as a cylinder or a partial cylinder or (2) provided with an end-to-end conductive path (not shown) thereon. One end of the reservoir 41 contacts or is otherwise electrically connected to one end ferrule 16. The other end of the reservoir 41 is normally closed by a diaphragm facility 42, to be described in detail with reference to FIGS. 6 and 11. The reservoir 41 is charged with a pressurized quantity of gaseous or liquid dielectric fluid 44, $SF_6$ being preferred. The pressurized fluid 44 is normally prevented from escaping the reservoir 41 by the diaphragm facility 42. As used herein, "pressurized" means that the pressure of the fluid 44 in the reservoir 41 is higher than the pressure within the remainder of the housing 12 before the device 10 operates.

Figure 6:
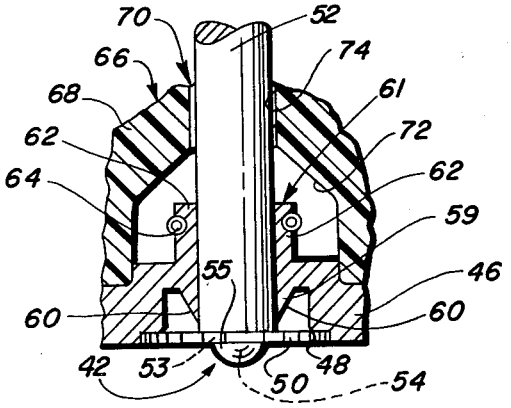
FIG. 6 is a magnified view of one embodiment of a portion of the device of FIG. 3.
Figure 11:
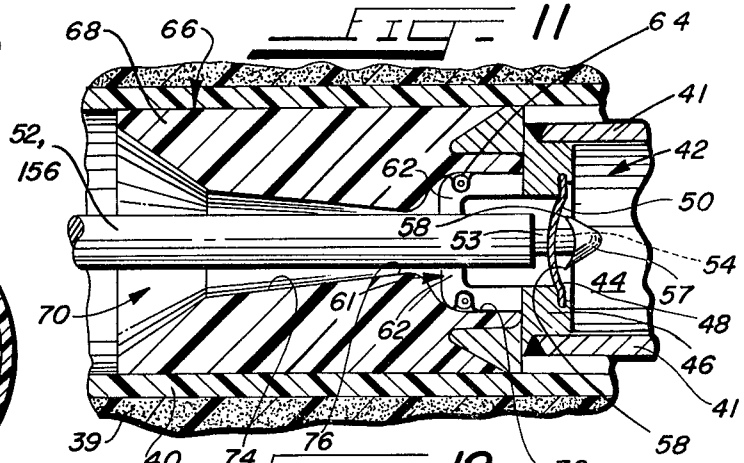
FIGS. 11 and 12 are magnified views of embodiments of portions of the devices depicted in FIGS. 3 and 8.

Referring to FIGS. 3, 6 and 11, the diaphragm facility 42 includes a wall 46 attached to, or formed integrally with the reservoir 41 in any convenient manner. The wall 46 includes a port 48 which is normally closed by a diaphragm, membrane, seal, or the like, 50. The diaphragm 50 is preferably a metal disk which may be flat or curved, as described below. The disk which has a relatively thin cross-section may have a constant cross-section, a varying cross-section, or either type of cross-section with a thinned zone or pattern formed therein. The diaphragm 50 is attached to the wall 46, whether it be metal or ceramic in any convenient manner, as by soldering or brazing, and has sufficient structural strength to resist bursting by the pressure of the fluid 44 within the reservoir 41. The diaphragm 50 also has the property of being rather easily cut, torn, burst, sliced or ripped by appropriate facilities, as described more completely below. Also as described below, facilities which apply high cutting or tearing forces to the diaphragm 50 are provided so that the property of the diaphragm 50 in resisting the pressure of the fluid 44 is not antithetical to its ability to be cut or torn.

A movable contact or arcing rod 52 has one end attached to the diaphragm 50. The arcing rod 52 is made of a conductive metal, preferably copper or copper alloy, and may be elongated along the central axis of the housing 12 although it may have different or shorter configurations. The arcing rod 52 may be simply mechanically attached to the diaphragm 50 by passing a necked-down portion 53 thereof through an aperture 54 formed in the diaphragm 50 and then forming a headed portion or button 55 on the necked-down portion 53 which is larger than the aperture 54. The necked-down portion 53 may be integral with or attached to the arcing rod 52, and may be a conductor, an insulator or an insulated conductor. A gas-tight seal may be effected by soldering or brazing the portion 53 to the wall of the aperture 54. The diaphragm 50 is made sufficiently thin, or may be pre-scored, so that when the arcing rod 52 moves away from the reservoir 41 the diaphragm 50 tears or rips to form a hole 56 (FIG. 7) therethrough, the arcing rod 52 carrying with it a fragment of the diaphragm 50. The pressurized fluid 44 then flows from the port 48 through the hole 56.

Referring to FIG. 11, alternatively to the button 55, there may be formed integrally with the necked-down portion 53 a frusto-conical cutting tip 57. The cutting tip 57 may include one or more cutting edges 58 so configured that movement of the arcing rod 52 away from the reservoir 41 causes the cutting edges 58 to come into contact with and cut or puncture the diaphragm 50, permitting free movement of the arcing rod 52 away from the diaphragm 50. The cutting edges 58 may be replaced by, or used with, knife edges (not shown) formed along the surface of the cutting tip 57 which slice through the diaphragm 50 at various locations as the arcing rod 52 moves away from the reservoir 41. Such cutting or slicing may directly form the hole 56 through the diaphragm 50 permitting the escape of the fluid 44 from the reservoir 41 as the arcing rod 52 carries with it the diaphragm fragment.

Alternatively, the cutting edges 58 or the knife edges may indirectly result in formation of the hole 56. Specifically, the edges may cut or slice through the diaphragm 50 at various locations, the hole 56 being formed by the rapid flow of the fluid 44 which outwardly deforms the now cut or sliced diaphragm 50. For this reason, the depiction of the fragment of the diaphragm 50 on the arcing rod 52, and the depiction of the remains of the diaphragm 50 at the port 48 in FIG. 7 are exemplary only.

The cutting tip 57 may be configured so as to ensure that the hole 56 is quite large. Specifically, the cutting edges 58 or the knife edges (not shown) may define a star pattern. When these edges cut or slice through the diaphragm 50, a plurality of separated, petal-like portions of the diaphragm 50 remain. These petal-like portions are then deformed outwardly by the fluid 44 flowing therepast, producing the enlarged hole 56. A similar effect may be achieved by a pre-scored, star-shaped pattern in the diaphragm 50 when the button 55 is used.

The diaphragm 50 may be essentially flat as shown in FIG. 3. The diaphragm 50 may also be concave where it faces the cutting edges 58 as shown in FIG. 11 as well as convex (not shown). Concavity or convexity of the diaphragm 50 permit some initial movement of the arcing rod 52 away from the reservoir 41 due to a slight deformation or an eversion of the diaphragm 50. Slight deformation or eversion of the diaphragm 50 permits some limited relative movement between the cutting edges 58, or the knife edges (not shown), and the diaphragm 50 until the edges cut or slice the diaphragm 50.

As shown only in FIG. 6, but permissible also with the cutting tip 57 of FIG. 11, the wall 46 may include one or more conical protrusions 59 surrounding the port 48 and the arcing rod 52. Tips 60 of the protrusions 59, which may be formed as the cutting tip of a can opener, are adjacent, but spaced from, the diaphragm 50. See FIGS. 3 and 6. When the arcing rod 52 moves away from the reservoir 41, the tips 60 cut into the diaphragm 50 as the button 55 or the cutting tip 57 pulls the diaphragm 50 thereagainst. The cutting tips 60 may be structurally and functionally similar to the cutting edges 58 to facilitate formation of the hole 56.

A normal electrical connection between the arcing rod 52 and the reservoir 41 may be effected via the diaphragm 50. Preferably, however, this normal electrical connection is provided by a tulip contact 61 or similar structure attached to or formed integrally with the wall 46. The tulip contact 61 may take any well-known configuration and may comprise a plurality of well-known sliding contact fingers 62 biased for a sliding electrical engagement with the arcing rod 52 by a garter spring 64. The fingers 62 are configured or spaced apart so as to not interfere with the flow of the fluid 44 from the port 48 or the hole 56, and may appear spoke-like when viewed end-on. Because the diaphragm 50 is to be torn, cut or ripped in a predictable manner, and because the diaphragm 50 must normally resist bursting forces applied thereto by the pressurized fluid 44, it is preferred that the diaphragm 50 normally carry little, if any, current. In this way, the ohmic heating effects of current flow through the diaphragm 50 can affect neither its ability to be cut or torn nor its burst resistance. The tulip contact 61 achieves these ends by shunting current through the arcing rod 52 and the reservoir 41 away from the diaphragm 50.

Current flow in the diaphragm 50 may also be prevented by rendering the button 55, the cutting tip 57 and the necked-down portion 53 non-conductive, thus normally forcing all current to flow in the interface between the arcing rod 52 and the tulip contact 61. In the event that normal non-conductors are not sufficiently robust, or may not be made sufficiently sharp, to ensure the tearing of the diaphragm 50, the elements 53, 55 and 57 may be a metal having a non-conductive oxide formed thereon, as by anodization.

As can be seen to this point, a continuous electric circuit is normally formed from the end ferrule 16 through the reservoir 41, the wall 46 and the tulip contact 61 to the arcing rod 52.

Attached to the wall 46 in any convenient manner may be a nozzle 66. The nozzle 66 includes a dielectric body 68 attached to the wall 46 and generally coaxial with the arcing rod 52, the port 48 and the housing 12. The dielectric body 68 may be made of a temperature-resistant material such as polytetrafluoroethylene, sold under the trade name Teflon. The dielectric body 68 contains a central passageway 70 comprising a first chamber 72 and a second chamber 74, the chambers 72 and 74 being interconnected by a restricted throat 76. The passageway 70 is so formed that gas flowing from the port 48 through the hole 56 torn or cut in the diaphragm 50 first passes through the chamber 72 and attains sonic or near-sonic velocity at or near the throat 76. Accordingly, gas flowing into the second chamber 74 and therebeyond moves at high velocity. It should be noted that the nozzle 66 as well as the wall 46 and the reservoir 41 are stationarily fixed within the housing 12 by the dielectric body 39. However, the arcing rod 52, as will be described in greater detail below, is designed to move axially of the housing 12 away from the reservoir 41 and away from and through the nozzle 66. Alternatively, but not depicted, the reservoir 41 and the nozzle 66 may be jointly movable while the arcing rod 52 is stationary. The important point is that the arcing rod 52 and the diaphragm 50 be relatively movable apart to effect the above-described formation of the hole 56.

Preferably, the hole 56 formed in the diaphragm 50 is larger than the passageway 70 at the throat 76. This ensures that the fluid 44 attains sonic velocity only at the throat 76 and is otherwise uninhibited in its flow from the port 48 until it reaches the throat 76. Because neither the button 55 nor the tip 52 may be larger than the throat 76, the formation of the hole 56 larger than the throat 76 is preferably achieved by (1) forming a thinned pattern larger than the throat 76 in the diaphragm 50 along which pattern the diaphragm 50 tears (for use with the button 55), or (2) use of the cutting or knife edges, referred to above, to slice the diaphragm 50 at various locations so that the flow of the fluid 44 outwardly deforms the sliced diaphragm 50 and elongates the slices already formed to enlarge the hole 56. Clearly, the size of the button 55 or of the cutting tip 57; the size and location of the cutting edges 58, the knife edges (not shown) or the tips 60; the size of the port 48; and the area of the diaphragm 50 may all be selected to ensure this relationship between the hole 56 and the throat 76. Moreover, it may be preferred that the diameters of the arcing rod 52 and the throat 76 be substantially equal so that the arcing rod 52 effectively closes the chamber 72 until it moves past the throat 76. This has the effect of preventing any substantial flow of the fluid 44 from the passageway 70 until a rather large separation between the arcing rod 52 and the reservoir 41 is present. Until this separation occurs, the chamber 72 acts as a plenum or accumulator for the fluid 44.

The end of the arcing rod 52 remote from the diaphragm 50 is located within a metallic conductive cylinder 78 at an end of the housing 12 opposite the reservoir 41. This end of the arcing rod 52 mounts a conductive piston 80, the outside periphery of which is complementarily shaped to the inside periphery of the cylinder 78. The piston 80 and the cylinder 78 form a piston-cylinder 81 for purpose to be set forth in greater detail below. The end of the cylinder 78 near which the piston 80 is normally located is closed by a wall 82 formed integrally with, or mounted in any convenient fashion to, the cylinder 78. The other end of the cylinder 78 is closed by a wall 90.

Figure 12:
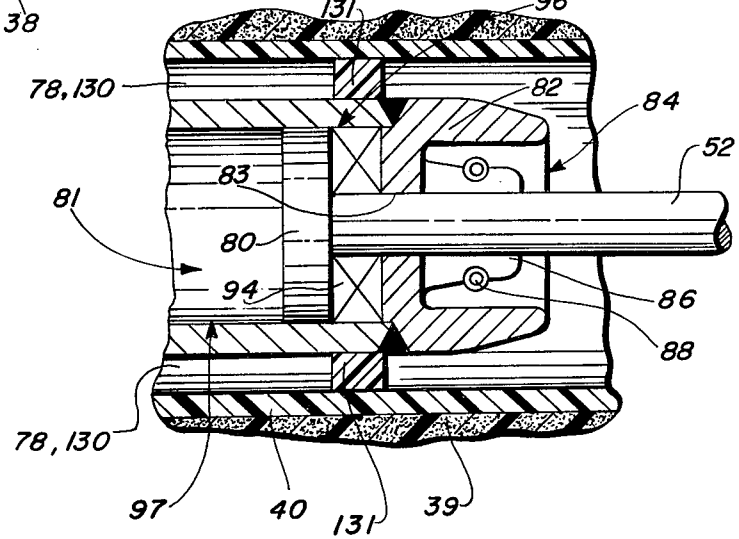
Figure 10:
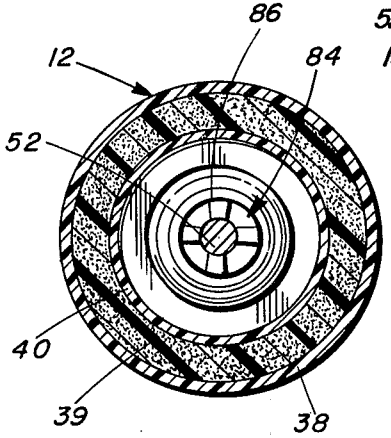
FIGS. 9 and 10 are sectional views, taken respectively along lines 9—9 and 10—10 of FIG. 8, showing in greater detail various aspects thereof.

The arcing rod 52 passes through an aperture 83 formed through the wall 82. Electrical continuity between the arcing rod 52 and the cylinder 78 may be effected by the engagement of the arcing rod 52 by the aperture 83, and the engagement between the piston 80 and the cylinder 78 (FIG. 3). To this end, the peripheries of the aperture 83 and of the piston 80 may contain any well-known sliding contact structure (not shown). Alternatively, as shown in FIG. 12, it is preferred that the wall 82 mount a tulip contact 84 surrounding the aperture 83. The tulip contact 84 may be similar to the tulip contact 61 and may include sliding contact fingers 86 and a garter spring 88.

Preferably positioned between the piston 80 and the wall 82 may be a power cartridge 94 or the like, which, upon ignition, rapidly generates expanding gas at a high rate. It may be seen from the structure thus far described, that ignition of the power cartridge 94 evolves gas 95 (FIG. 7) to pressurize a first volume 96 defined by the piston 80, and the wall 82 and the walls of the cylinder 78. The ignition of the power cartridge 94 and the consequent pressurization of the volume 96 applies a force to, and moves, the piston 80 to expand the first volume 96. Expansion of the first volume 96 is accompanied by a decrease of a second volume 97 defined by the piston 80, the wall 90 and the cylinder 78. The power cartridge 94 is selected so that sufficient force is applied to the piston 80 to rapidly move the arcing rod 52 in an upward direction as viewed in FIGS. 3 and 6 (leftward in FIGS. 11 and 12). Upward movement of the arcing rod 52 initially effects the above-described cutting or tearing of the diaphragm 50 to release the dielectric fluid 44 from the reservoir 41. After the flow of the dielectric fluid 44 through the port 48 and the hole 56 begins, further upward movement of the arcing rod 52 occurs, as pressurization and further expansion of the volume 96 continues. As the arcing rod 52 continues to move upwardly, it electrically disengages from the tulip contact 61, or if such is not used, electrical continuity between the arcing rod 52 and the reservoir 41 is broken as the diaphragm 50 is torn or ruptures. Also, the cutting tip 57, or alternatively the button 55, is drawn through the passageway 70 of the nozzle 66. The tulip contact 84, or the contact between element pairs 52/83 and 78/80, maintains the cylinder 78 in electrical continuity with the arcing rod 52.

The power cartridge 94 is preferred, because it permits the generation of large forces and high energy in a short time, to ensure the cutting or tearing of the diaphragm 50 upon movement of the arcing rod 52 regardless of how robust the diaphragm 50 is made to normally resist the pressure of the fluid 44. However, other facilities (not shown) for moving the arcing rod 52 may also be used. For example, a hydraulic, or other high-fluid-pressure-generating, system may be connected to the first volume 96 so as to effect its rapid expansion and the concomitant rapid movement of the arcing rod 52. Also, a power cartridge 94 outside of, but connected to, the volume 96 may be used. Moreover, the piston-cylinder 80–78 may be replaced by equivalent structure such as a bellows or the like. The only constraints on whatever operator for the arcing rod 52 is chosen are that it must generate (a) sufficient force and energy to positively form the hole 56; and (b) sufficient force and energy to rapidly relatively move the arcing rod 52 and the reservoir 41 apart after formation of the hole 56.

Present at the sliding interface of the arcing rod 52 and the aperture 83 may be a sealing structure (not shown), such as an O-ring or the like, which prevents the ignition products of the power cartridge 94 from contaminating the fluid 44. These ignition products may include conductive portions, such as metal ions, which could degrade or supersede the arc-extinguishing properties of the fluid 44. The sealing structure may also form a part of the tulip contact 84.

The cylinder 78 may be maintained in constant electrical contact with the end ferrule 14 by a threaded, flared portion 98 which may be interfitted with internal threads on the ferrule 14. Accordingly, a normal, continuous current path through the device 10 includes: the end ferrule 16; the reservoir 41; the wall 46; the sliding contact 61 (or the diaphragm 50 where the contact 61 is not used); the arcing rod 52; the contact between the element pairs 52/83 and 78/80 (or the tulip contact 84); the cylinder 78, the wall 90, the flared portion 98, and the end ferrule 14. The wall 90 may be vented as at 99 to obviate compression in the second volume 97 which might inhibit movement of the piston 80.

After the end ferrules 14 and 16 are electrically connected to opposed points of the circuit 33 and 34, a sensing and triggering device 100 may generate a signal which ignites the power cartridge 94. As shown in FIGS. 3 and 7, this ignition moves the piston 80 upwardly (leftwardly in FIGS. 11 and 12). Movement of the arcing rod 52 due to movement of the piston 80 causes the above-described cutting, tearing or rupturing of the diaphragm 50, permitting the sudden release in great quantity and at high velocity of the fluid 44 from the reservoir 41. Such fluid 44 flows from the port 48 through the hole 56 and travels along the arcing rod 52. Movement of the arcing rod 52 breaks the electrical contact between such arcing rod 52 and the tulip contact 61 (or between the arcing rod 52 and the reservoir 41 if the tulip contact 61 is not used). Because the device 10 is connected in the high voltage circuit 33 and 34, an arc will be established between the arcing rod 52 and a stationary contact which may comprise the tulip contact 60 or some part of the wall 46 adjacent the port 48.

As used herein with reference to this first embodiment, the term "stationary contact" refers to the tulip contact 60, the wall part adjacent the port 48 or any other structure electrically continuous with the ferrule 16 and on or associated with the reservoir. As defined earlier, the term "movable contact" refers to the arcing rod 52, to some part thereof or to equivalent structure. These contacts—the arcing rod 52 and the stationary contact—receive respective ends of the arc which is established when electrical continuity between the arcing rod 52 and the reservoir 41 is broken. Relative movement apart of the contacts—here effected by movement of the arcing rod 52—elongates the arc in the gap between the contacts. The term "gap" refers to the physical separation, and distance between, the contacts. As discussed above, the piston-cylinder 81 may move the reservoir 41 while the arcing rod 52 is stationary. In this event, "stationary contact" refers to the arcing rod 52 or a part thereof as well as the equivalent structure, and "movable contact" means the tulip contact 61, the wall part adjacent the port 48 or other contact structure on, or associated with, the reservoir 41. Obviously, both the arcing rod 52 and the reservoir 41 may be movable. What is important is that relative contact movement occurs to tear the diaphragm 50 and to elongate the arc in the gap.

In the embodiment of FIGS. 3, 6, 7, and 11, the arc is established between either the button 55 or the cutting tip 57 and the tulip contact 61. If the button 55 or the cutting tip 57 are not conductive, one end of the arc will be received by a portion of the arcing rod 52 adjacent the necked-down portion 53. Alternatively, where the elements 53, 55, and 57 are covered with an anodic, non-conductive oxide or the like, they may receive one end of the arc after it burns through the oxide.

As the arc is established, the fluid 44 flows from the port 48 and is directed at and into the vicinity of the arc by the nozzle 66, while the arcing rod 52 continues to move to elongate the arc. Ultimately, the turbulent, cooling and deionizing properties of the fluid 44, plus the elongation of the arc by relative movement between the arcing rod 52 and the tulip contact 61, effect extinguishment of the arc at some subsequent current zero. Following arc extinguishment, the arcing rod 52 continues to move until further movement of the piston 80 is prevented by structure to be subsequently described.

The sensing and triggering device 100 may take any convenient form and is preferably an electronic overcurrent-sensing and control circuit which is either selected or adjustable to have a predetermined time-current characteristic. In this event, the device 100 may sense current levels in the circuit 33 and 34 to automatically ignite the power cartridge 94 when the current level is within a predetermined abnormal range. Alternatively, the device 100 may ignite the power cartridge 94 in response to some condition other than the current level in the circuit 33 and 34. One such condition may be the pressure within the transformer 36. Thus, the device 10 may operate to protect the circuit 33 and 34 and the transformer 36 from overcurrents or fault conditions; it may also be used to interrupt the circuit 33 and 34 for reasons other than overcurrents or faults, including merely the desire to open the circuit 33 and 34 for any reason. The latter type of operation of the device 10 which does not depend on an overcurrent or fault may be referred to as "shunt tripping", and can occur even if the current in the circuit 33 and 34 is within acceptable limits. The device 100 may, therefore, provide in conjunction with the device 10 either circuit protection or shunt tripping or both.

The use of the device 100 is not mandatory. Other facilities may be used. For example, a sensor (not shown) such as current transformer, or a direct connection (not shown) to the circuit 33 and 34, may be located in one of the mountings 26 or 30 to generate an output proportional to, or equal to, the current level in the circuit 33 and 34. This output may be fed to the power cartridge 94, ignition of which may be normally prevented by a typical fusible element (not shown) shunting the power cartridge 94. When the current level in the circuit 33 and 34 gets sufficiently high, the fusible element melts to direct the full output to the power cartridge 94 for ignition thereof. The sensing and triggering device 100 may be contained in either of the mountings 26 or 30 and may conveniently take the form of a plug-in module. The device 100 is generally shown in FIGS. 1 and 2 in the mounting 30.

Insulated conductors 104 may run between the sensing and triggering device 100 or other sensor (not shown) and the power cartridge 94. These conductors 104 may follow any convenient path through one of the mountings 26 or 30, through the latch or hinge 24 or 28 and through one of the end ferrules 14 or 16. Ultimately, the conductors 104 enter the housing 12 and preferably run along the reservoir 41 or the cylinder 78 for attachment to the power cartridge 94 through the side of the conductive cylinder 78. The conductors 104 carry the output of the device 100 or other sensor (not shown) to the power cartridge 94 for ignition thereof. Where the fusible element (not shown) is used to normally prevent ignition of the power cartridge 94, such may be located within the housing 12 or outside thereof and may be connected across the conductors 104 or elsewhere.

As is well known, the power cartridge 94 may comprise a so-called pressure cartridge which is capable of generating energy for any system requiring work. Such cartridges 94 usually include a hermetically sealed unit containing smokeless powder or the like and a fusible bridge wire, the heating or fusing of which ignites the powder. Typical power cartridges 94 are ignited by low currents, typically in the 5 ampere range. Such cartridges are available from Quantic Industries, Inc. of San Carlos, Calif. and Holex of Hollister, Calif. U.S. Pat. Nos. 3,851,219 and 3,400,301 and French Pat. No. 2,262,393 disclose the general use of such cartridges in fuses or in fuse-like devices. The following articles provide additional background on the use of such cartridges: "A Current-Limiting Device for Service Voltages Up To 34.5 kV" by Keders and Leibold, Paper A76-436-6 presented at the IEEE PES Summer Meeting, Portland, Ore., July 18–23, 1976; Limiting Fault Currents Between Private and Public Networks" by M. C. Blythe in *Electrial Review* (U.K.) Oct. 5, 1973; and, "Fault Levels Too High?", leaflet No. 1197/6E of Calor-Emag Elelctrizitats-Aktiengesellschaft, Ratingen, West Germany.

The sensing and triggering device 100, where present, is used functionally to (1) sense overcurrents in the circuit 33 and 34 or to sense some other condition. Such sensing may be effected, in part, by any convenient sensor in any known fashion, e.g., by a current transformer in the circuit 33 and 34, or by a pressure sensor in the transformer 36; and (2) transmit an ignition signal to the cartridge 94.

Where overcurrent or fault sensing is involved, both functions (1) and (2) may be performed in a manner similar to the more usual form of fuse. Additionally, only a certain range of current flowing for certain times in the circuit 33 and 34 may effect ignition of the cartridge 94 along the lines of time-current-characteristic-determining devices used in circuit breakers. Any other intelligence or processing device between any type of sensor and the power cartridge 94 is within the skill of the art and forms no part of the present invention.

The device 10 is a so-called one-shot device. After the device 10 has interrupted the circuit 33 and 34, the entire device 10 may be replaced with a new device 10 for subsequent protection of the circuit 33 and 34 and of the transformer 36. Alternatively, the device 10 may be constructed so that only certain parts need to be replaced following operation. Specifically, one ferrule, say the ferrule 14, may be so attached to the housing 12 as by a threaded fit with the flare 98 to permit its selective removal. Following such removal, either the insulative cylinder 40, or the body 39, or both, may be removed, carrying therewith the reservoir 41, the nozzle 66, the arcing rod 52, and the piston-cylinder 81. A new cylinder 40 or body 39 is then inserted into the housing 12 carrying therewith the elements 41, 66, 52 and 81 as well as a new power cartridge 94.

The reservoir 41 may be fitted with a filling nipple 112 which may normally threadingly seat in a conformal aperture 113 in the interior of the ferrule 16. The elements 41, 52, 66, 81 and 94 may be removed, following removal of the ferrule 14, by disengaging the nipple 112 from the aperture 113. Alternatively, the nipple 112 may extend beyond the exterior of the device 10. The nipple 112 is attachable to a source of the fluid 44 for filling the reservoir 41 to a predetermined pressure. Preferably, this is done during manufacture of the device 10, but can also be done in the field. The pre-pressurization of the reservoir 41, and the above-described operation mean that the device 10 is not a typical "puffer" type of circuit-interrupting device: the flow of the dielectric fluid 44 from the port 48 after the diaphragm 50 has been torn or cut depends solely upon the pressure of the fluid 44 within the gas reservoir 41.

Should it be desired to use the device 10 in the dropout or dropdown configuration depicted in FIGS. 1 and 2, the end of the arcing rod 52 to which the piston 80 is attached may mount a pin 114. Normally positioned adjacent an aperture 115 in the wall 90 is a movable latch pin 116 mounted for sliding movement through an aperture 118 in the ferrule 14. The latch pin 116 is maintained in the normal position depicted in FIG. 3 by a spring or the like (not shown). Upon reaching the wall 90, the pin 114 enters and passes through the aperture 115 and contacts the latch pin 116, which is moved outwardly of the ferrule 14. Such movement of the latch pin 116 operates the latch 24 to release it from the latch mechanism 26 so that the device 10 may rotate on its hinge 28 about the hinge mechanism 30 to the dropout or dropdown position shown in dotted lines in FIGS. 1 and 2.

The pin 114 may also be used to operate an operation indicator (not shown), in the event the device 10 does not drop down or drop out, to give a visual indication of its operation. The operation indicator may comprise a window (not shown) in the housing 12 or the ferrule 14 which permits visual observation of the pin 114 or of a flag (not shown) moved adjacent the window by the pin 114. The pin 114 or the flag may be brilliantly colored to aid such visual observation.

Figure 14:
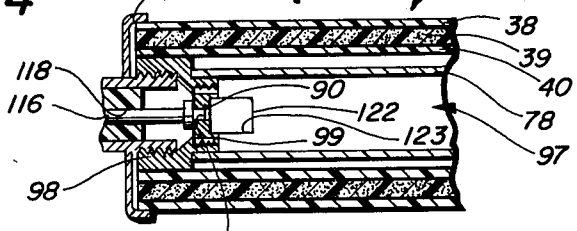
FIG. 14 is a partially-sectioned, partial side view of a single gap circuit interrupting device which is an alternative to a portion of the device shown in FIG. 3.

Referring now to FIG. 14, mounted inside the conductive cylinder 78 coaxially with the aperture 115 may be a shock absorber 122. The shock absorber 122 dissipates energy, slowing down and ultimately stopping the piston 80 and the arcing rod 52 as the piston 80 strikes and collapses the shock absorber 122. The shock absorber 122 may comprise a flexible or compliant rubber member or a crushable, thin-walled metal cylinder, either of which are able to absorb the kinetic energy of the moving system comprising the piston 80, the arcing rod 52 and the latch operating pin 114. Preferably, the shock absorber 122 has a central hole 123 for passage therethrough of the pin 114.

The shock absorber 122 may serve another function, namely prevention of movement of the arcing rod 52 after the device 10 has operated. This is important where, as depicted in FIGS. 1 and 3, the ferrule 14 toward which the arcing rod 52 is at the top of the device 10. If steps are not taken, gravity may move the arcing rod 52 back to its initial position following operation of the device 10, thus reinitiating the conductive path between the ferrules 14 and 16. To prevent such movement, the shock absorber 122 may, following its collapse, frictionally engage the pin 114, locking the arcing rod 52 in the upper end of the device 10. To this same end, the pin 114 and the aperture 115 may be dimensionally related so as to cause the pin 114 to become wedged therein. The shock absorber 122 and the wedging of the pin 114 and the aperture 115 may be used whether the device 10 is used in the configuration of FIGS. 1 and 2 or in a non-dropout or non-dropdown configuration, with or without an operation indicator. Clearly, other arrangements, such as a slightly decreased diameter of the inside of the cylinder 78 or spring fingers thereon, could be provided to engage or lock the piston 80 after operation of the device 10.

Where the device 10 is used in a dropout or dropdown mode, steps may be taken—aside from the shock absorber 122 and the wedging of the elements 114 and 115—to ensure that the latch pin 116 remains in its outward position and that rotation of the device 10 to the dotted line positions of FIGS. 1 and 2 occurs. Specifically, the aperture 118 in the ferrule 14 may be lined or filled with a polymer or elastic material which permits movement of the latch pin 116 by the pin 114, but which frictionally maintains the latch pin 116 in its outer position.

Figure 16:
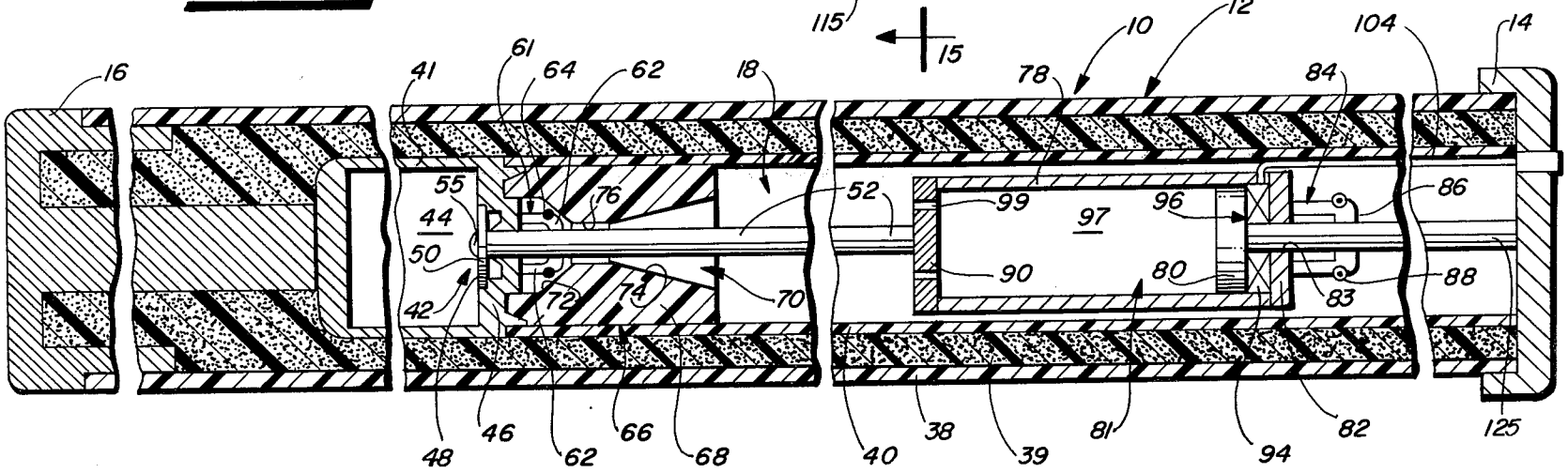
FIG. 16 is a partially sectioned, side view of a single gap circuit interrupting device which is an alternative to the device of FIG. 3.

Interrupting Unit 18—Second Embodiment—FIG. 16

A second embodiment of the invention appears in FIG. 16. The device 10 includes many of the same or similar elements depicted in FIG. 3. These elements are identified by the same or similar reference numerals.

In the device 10 of FIG. 3, the piston 80 moves to move the arcing rod 52. Thy cylinder 78 is stationary. The reverse is the case in FIG. 16: the piston 80 is stationary and the cylinder 78 moves.

To this end, a stationary piston rod 125 is mounted at one end to the inside of the ferrule 14, its other end passing through the aperture 83 in the wall 82 of the cylinder 78 for connection to the piston 80. The arcing rod 52 is attached to the cylinder 78 for movement therewith.

Figure 15:
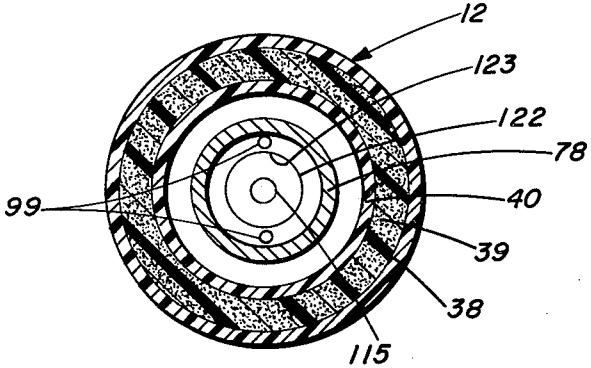
FIG. 15 is a sectional view of FIG. 14, taken along line 15—15 thereof.
Figure 9:
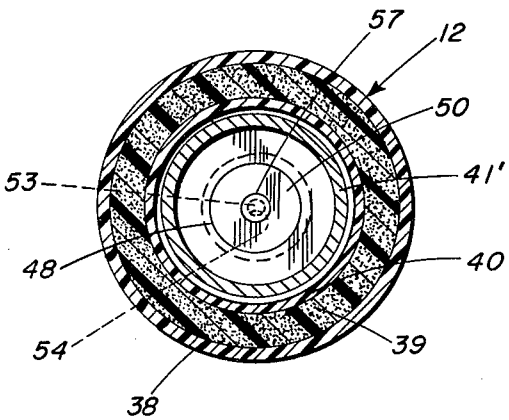

Ignition of the power cartridge 94 in the first volume 96 moves the cylinder 78 rightwardly to move the arcing rod 52. The rest of the structure and operation of the device 10 in FIG. 15 is as described above with reference to the First Embodiment including all alternative and optional structure thereof. A tulip contact 84 similar to that in FIG. 12 may be provided at the right end of the cylinder 78 to ensure electrical continuity between the cylinder 78 and the piston rod 125. If it is desired that the device 10 of FIG. 15 perform a dropout, dropdown or operation-indicating function, the right end of the cylinder may carry a pin (not shown) similar in function and structure to the pin 114 in FIGS. 3, 7 and 14.

As with the device 10 of FIG. 3, the device 10 of FIG. 16 may include a stationary arcing rod 52 and a movable reservoir 41. If this is desired, the arcing rod 52 is mounted to the ferrule 16 and the cylinder 18 is connected to the reservoir 41 by a connecting rod (not shown). The nozzle 66 and the tulip contact 61 move with the reservoir.

Figure 13:
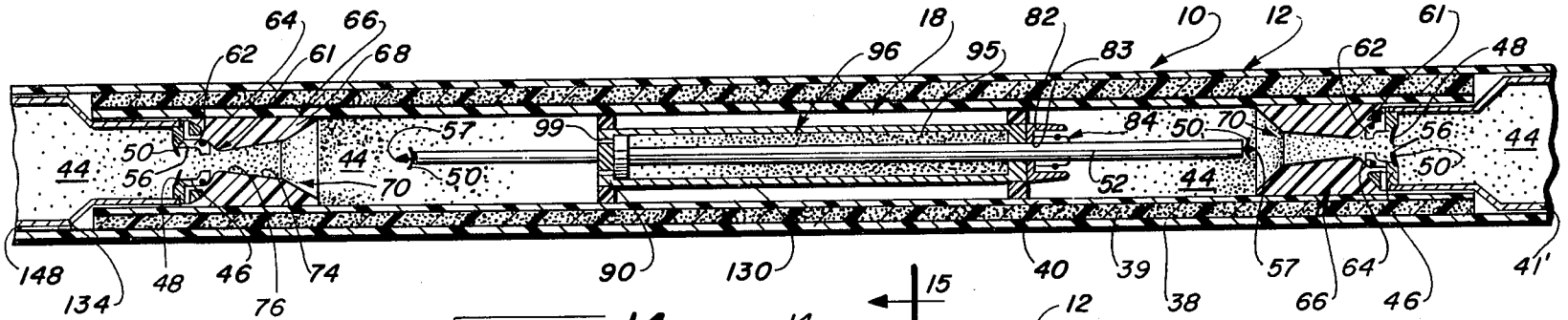
FIG. 13 is a view similar to FIG. 8, showing the device of the present invention following operation thereof.

Interrupting Unit 18—Third Embodiment—FIGS. 8 and 13

The devices 10 depicted in FIGS. 3 and 16 are so-called single-gap devices. Specifically, a single-gap (between the arcing rod 52 and the tulip contact 61) is opened during circuit interruption. The device 10, shown FIGS. 8 and 13, is a two-gap device. The two-gap device 10 has much structure which is, or may be, similar to, or the same as, that shown in FIGS. 3, 6, 7, 11, 12 and 15. Such structure is shown in FIGS. 8 and 13 by the same or similar reference numerals.

The right-hand side of the device 10 is similar to the mirror image of the device 10 depicted in FIGS. 3 and 16. Specifically, a movable cylinder 130 made of a conductive metal and similar to the stationary cylinder 78 of FIGS. 3 and 15 is mounted for movement within the housing 12. The cylinder 130 contains the conformal piston 80 and is closed at either end by the walls 82 and 90. The wall 90 is vented as at 99 while the wall 82 has the aperture 83 through which a right-hand arcing rod 52 moves. The sliding contact 84 may surround the aperture or electrical continuity between the arcing rod 52 and the cylinder 130 may be otherwise ensured by contact between element pairs 52/82 and 80/130, similar to FIGS. 3 and 7. The arcing rod 52 is connected to the piston 80 for movement therewith.

The arcing rod 52 is normally restrained by the diaphragm 50 which normally closes the port 48 of a right-hand stationary reservoir 41'. The arcing rod 52 is normally in electrical continuity with the reservoir 41' via the sliding contact 61. Movement of the arcing rod 52 away from the reservoir 41' and the contact 61 is through the passageway 70 of the nozzle 66. The end of the arcing rod 52 may mount the cutting tip 57, as shown in FIGS. 8, 11 and 13, or may include only the simple button 55 as in FIGS. 3, 6 and 7, in which latter event the wall 46 of the reservoir 41' may include the conical protrusion 59 to aid in tearing the diaphragm 50.

The stationary reservoir 41' of FIGS. 8 and 13 is functionally the same as the reservoir 41 of FIGS. 3 and 7 but is structurally slightly different. The reservoirs 41 and 41' are alternatives usable in the devices 10 of FIGS. 3 or 8. Specifically, the reservoir 41' fills the right-hand end of the housing 12 and is closed by an end ferrule 16' rather than by an integral end wall as in FIG. 3. The ferrule 16' of FIG. 8 is functionally similar to the ferrule 16 of FIG. 3 but may engage both the reservoir 41' and the housing 12 via a circular groove 132 formed therein. The filling nipple 112 for the reservoir 41' passes through the ferrule 16' which in turn carries the end fitting 22 partially shown in FIG. 8.

The left-hand side of the device 10 in FIGS. 8 and 13 is the mirror image of the right-hand side and includes a second reservoir 134 fillable with the dielectric fluid 44 to a predetermined pressure by a nipple 136. The reservoir 134 includes a diaphragm facility 42 similar to that included with the reservoirs 41 and 41', and also may include the tulip contact 61. Adjacent the port 48 of the reservoir 134 is a nozzle 66. The port 48 is normally closed by a diaphragm 50 and the conical protrusion 59 may be included on the wall 46 as desired.

The nipple 136 is attached to an end closure 138 which may be formed integrally with the reservoir 134 if desired. The closure 138 has a hollow flange 140 which mounts a hollow conductive member 142 passing through a ferrule 14' and vented at 143, the flange 140 and the member 142 forming a continuous passageway 144. The reservoir 134 and the housing 12 define a space 148 therebetween. The area within the housing 12 between the nozzles 66, 66 communicates with the passageway 144 via passageway 70 in the left-hand nozzle 66, the space 148 and the vents 143. The passageway 144 is sealed with a bellows 152 mounted to the member 142 and normally held in a contracted position by its own spring tension. The bellows 152 expands outwardly of the device 10 whenever the pressure within the housing 12 increases. The bellows 152 may carry on its outer end a pin (not shown) functionally similar to the pin 114 or to the latch pin 116 for a similar purpose.

A second movable contact or arcing rod 156 similar to the arcing rods 52 is provided at the left-hand side of the device 10. The second arcing rod 156 includes a necked-down portion 53 passing through an aperture 54 in the diaphragm 50 which may have at its end the button 55 or the cutting tip 57. The second arcing rod 156 is attached at its other end to the wall 90 of the movable cylinder 130 for movement therewith.

A power cartridge 94 is located between the piston 80 and the wall 82 of the cylinder 130. Leads (not shown) to the power cartridge 94 may follow any convenient path within the device 10 from the sensing and triggering device 100 or other ignition initiator. Ignition of the power cartridge 94 moves the piston 80 to the left and the cylinder 130 to the right.

The operation of the device 10 of FIG. 8 (as shown in FIG. 13) is similar to the devices 10 of FIGS. 3 and 16 except that two gaps are formed and in each gap an arc is struck. Each arc is extinguished by the operation of the device 10. Specifically, a normal continuous current path through the device 10 is formed from the end ferrule 16' through the right-hand reservoir 41', the sliding contact 61, the right-hand arcing rod 52, the sliding contact 84, the movable cylinder 130, the second arcing rod 156, the sliding contact 61 on the reservoir 134, the closure 138, the member 142, and the ferrule 14'.

Ignition of the power cartridge 94 has the effect of relatively moving the piston 80 and the cylinder 130 to increase the first volume 96 and decrease the second volume 97. This relative movement between the piston 80 and the cylinder 130 moves the arcing rods 52 and 156 toward each other and away from their respective reservoirs 41' and 134. Leftward movement of the right-hand arcing rod 52 effects release of the fluid 44 from the right-hand reservoir 41' and elongation of the arc struck between the arcing rod 52 and the contact 61. Rightward movement of the arcing rod 156 releases the dielectric fluid 44 from the reservoir 134 and elongates an arc established between the arcing rod 156 and the contact 61. Accordingly, ignition of the power cartridge 94 causes a rapid dielectric fluid flow from both reservoirs 41' and 134 followed by the establishment and elongation of two arcs. Both arcs are ultimately extinguished at a subsequent current zero.

Release of the dielectric fluid 44 from the reservoirs 41' and 134 increases the pressure within the passageway 144 to expand outwardly the bellows 152. This expansion moves the latch pin (not shown) outwardly to operate the latch 24 permitting dropout movement of the device 10. The device 10 may be used in a non-dropout mode in which event the elements 140, 142, 143 and 152 may be eliminated or may be used to provide an operation indication.

To prevent relative movement of the piston 80 and the cylinder 130 after the device 10 operates the cylinder 130 may have a decreased diameter (not shown) against which the piston 80 wedges. To the same end, the cylinder 130 may contain internal spring fingers (not shown) which engage and hold the piston 80, or the piston 80 may mount a pin, similar to the pin 114 which wedges in a hole (not shown) formed in the wall 90. Relative movement of the cylinder 130 and the housing 12 following operation of the device 10 may be similarly prevented. For example, the insulative cylinder 40 may have a decreased diametric dimension (not shown) or spring fingers (not shown) which hold the cylinder 130 in the position shown in FIG. 13.

CONCLUSION

While three alternative embodiments of the present invention have been described in detail herein, it should be understood that various changes can be made without departing from the scope of this invention. Clearly, dielectric fluids other than $SF_6$ may be used within the reservoirs 41, 41' and 134. Moreover, the various components of the devices 10 may be made of any material which performs the described function, whether the function is to conduct electrical current or to insulate thereagainst. It should also be noted that the devices 10 need not be dropout or dropdown types in which case various latch-related and hinge-related elements need not be present. Further, in the devices 10, the various elements of the interrupting units 18 may be selectively replaceable by removing one of the ferrules 14 or 16 and refilling the housing 12 with a new interrupting unit 18, modularly contained in the dielectric body 39 or in the insulative cylinder 40, either of which may be removable from the housing 12.

As described earlier, the diaphragm 50 is preferably a disk which normally fills and closes the port 48. It may be preferred that the diaphragm take other forms, for example, an annulus (not shown). The outer edge of the annulus would then be sealed to the edge of the port 48 and the movable contact 52 would be sealed to the edge of the central opening through the annulus. Movement of the movable contact 52 away from the reservoir 41 would destroy or break one or both of these seals or would tear or rip the diaphragm. By logical extension, the annular diaphragm could, in turn, be replaced by a quantity of soldering, brazing, sealing or the like material (not shown) which seals the movable contact 52 to the edge of the port 48. Again, movement of the movable contact 52 would tear, break or otherwise destroy the seal. In either case, seals are removed by a force applied in the direction the fluid 44 flows from the port 48. Thus, the words "diaphragm" and "tearing" shall have meanings broad enough to encompass these variants of the present invention.

What is claimed is:

1. An improved circuit interrupting device of the type having a reservoir of pressurized dielectric fluid with a port for directing the fluid at an arc, and a pair of relatively movable contacts which receive respective ends of the arc as they move apart, wherein the improvement comprises:
a diaphragm normally closing the port;
means for tearing the diaphragm to open the port in response to relative movement apart of the contacts, the tearing means tearing the diaphragm by applying thereto a tearing force in the same general direction in which the fluid flows from the port; and
means for relatively moving the contacts apart.

2. A device according to claim 1, wherein
one contact is on the reservoir.

3. A device according to claim 2, wherein
the tearing means comprises
a mechanical attachment between the diaphragm and the other contact, relative parting contact movement effecting relative movement apart of the other contact and the diaphragm to tear the diaphragm.

4. A device according to claim 3, wherein
the moving means comprises
piston-cylinder means, relative movement between a piston and a cylinder thereof relatively moving the contacts; and
power cartridge means, ignition of which relatively moves the piston and the cylinder.

5. An improved device according to claim 1, wherein
one contact is a portion of the reservoir adjacent the port.

6. A device according to claim 1, wherein
the tearing means comprises
a mechanical attachment between the diaphragm and one of the contacts, relative parting contact movement effecting relative movement apart of the one contact and the diaphragm to tear the diaphragm.

7. A device according to claim 1, wherein
the moving means comprises
piston-cylinder means, relative movement between a piston and a cylinder thereof relatively moving the contacts.

8. A device according to claim 7, wherein
the moving means further comprises
power cartridge means for relatively moving the piston and the cylinder upon ignition thereof.

9. A device according to claim 1, wherein
the moving means comprises
power cartridge means.

10. A device according to claim 1, wherein
the tearing means comprises
a mechanical attachment between the diaphragm and one of the contacts, relative parting contact movement effecting relative movement apart of the one contact and the diaphragm to tear the diaphragm.

11. A device according to claim 1, wherein
the moving means comprises
piston-cylinder means, relative movement between a piston and a cylinder thereof relatively moving the contacts.

12. A device according to claim 11, wherein
the moving means further comprises
force-generating means.

13. A device according to claim 12, wherein
the force-generating means comprises
a power cartridge.

14. A device according to claim 1, wherein
the moving means comprises
force-generating means.

15. A device according to claim 14, wherein
the force-generating means comprises
a power cartridge.

16. A device according to claim 1, wherein
one contact comprises
sliding contact means mounted by the reservoir for slidably contacting the other contact until a predetermined amount of relative parting movement of the contacts has occurred.

17. A device according to claim 16, wherein
the tearing means comprises
a mechanical attachment between the diaphragm and the other contact, relative parting contact movement effecting relative movement apart of the other contact and the diaphragm to tear the diaphragm.

18. A device according to claim 17, wherein
the tearing means further comprises
means on the other contact normally positioned in the reservoir for tearing the diaphragm in response to relative movement apart of the other contact and the diaphragm.

19. A device according to claim 18, wherein
the moving means comprises
piston-cylinder means for relatively moving the contacts apart.

20. A device according to claim 18, wherein
the moving means comprises
power cartridge means for relatively moving the contacts upon ignition thereof.

21. A device according to claim 18, wherein
the moving means comprises
piston-cylinder means for relatively moving the contacts upon relative movement of a piston and a cylinder thereof; and
power cartridge means for relatively moving the piston and the cylinder upon ignition thereof.

22. A device according to claim 21, wherein
the cylinder is stationary and the other contact moves with the piston.

23. A device according to claim 21, wherein
the piston is stationary and the other contact moves with the cylinder.

24. A device according to claim 21, wherein
the piston and the cylinder are both movable and one contact moves with either the piston or the cylinder.

25. A device according to claim 1, wherein
one contact is on the reservoir;
the other contact is mechanically attached to the diaphragm so that relative contact movement moves the diaphragm and the other contact apart to tear the diaphragm; and which further comprises
means for electrically connecting the contacts until a predetermined amount of relative parting contact movement has occurred.

26. A device according to claim 25, wherein
the reservoir is stationary, and
the other contact is movable.

27. A device according to claim 25, wherein
the reservoir is movable, and
the other contact is stationary.

28. A device according to claim 25, wherein the reservoir and the other contact are movable.

29. An improved circuit interrupting device of the type having an insulative housing carrying opposed circuit-connectable terminals, a reservoir of pressurized dielectric fluid with a port for directing the fluid at an arc, and a movable contact which receives one end of the arc as it moves from a normal first to a second position, wherein the improvement comprises:

the reservoir being electrically conductive;

a diaphragm normally closing the port;

means for tearing the diaphragm to open the port in response to movement of the movable contact out of the first position;

means for moving the movable contact out of the first position; and first means for electrically connecting the movable contact to the reservoir when the movable contact is in the first position and for receiving the other end of the arc as the movable contact moves to the second position.

30. A device according to claim 29, wherein the moving means comprises a power cartridge.

31. A device according to claim 30, wherein the moving means further comprises piston-cylinder means for moving the movable contact in response to ignition of the power cartridge.

32. A device according to claim 29 which further comprises second means for continuously electrically connecting the movable contact to one terminal; and third means for continuously electrically connecting the reservoir to the other terminal.

33. A device according to claim 32, wherein the moving means and the second means together comprise piston-cylinder means having a piston and a cylinder, and being electrically connected to the one terminal for moving the movable contact; and a power cartridge, ignition of which effects movement of the movable contact by the piston-cylinder means.

34. A device according to claim 29, wherein the moving means comprises piston-cylinder means for moving the movable contact.

35. A device according to claim 34, wherein the piston-cylinder means comprises a stationary cylinder, and a movable piston attached to the movable contact.

36. A device according to claim 35, wherein the piston-cylinder means further comprises a power cartridge, ignition of which relatively moves the piston and the cylinder.

37. A device according to claim 34, wherein the piston-cylinder means comprises a stationary piston, and a movable cylinder attached to the movable contact.

38. A device according to claim 37, wherein the piston-cylinder means further comprises a power cartridge, ignition of which relatively moves the piston and the cylinder.

39. A device according to claim 33, wherein a portion of the movable contact passes through the cylinder for attachment to the piston, and wherein the second means comprises sliding contact means electrically connected to the cylinder and surrounding the movable contact portion at its point of passage through the cylinder for continuously, slidingly contacting the movable contact in all positions thereof.

40. A device according to claim 29, wherein the tearing means comprises an end of the movable contact which passes through and is normally held in the diaphragm; and a tip on the movable contact end normally within the reservoir and so arranged that movement of the movable contact toward the second position causes the tip to tear the diaphragm out of the port.

41. A device according to claim 40, wherein the tip comprises a cutting edge directed toward the diaphragm in the direction of movable contact movement from the first to the second position.

42. A device according to claim 29, wherein the tearing means comprises a cutting member adjacent the diaphragm and outside the reservoir; and a mechanical connection between the movable contact and the diaphragm, movement of the movable contact toward the second position pulling the diaphragm against the cutting member to tear the diaphragm.

43. The device of claim 29, wherein the moving means comprises piston-cylinder means for moving the movable contact.

44. The device of claim 43, wherein the piston-cylinder means comprises a piston;

a cylinder enclosing the piston, the piston and the cylinder being relatively movable and defining a first volume and a second volume on either side of the piston, the first volume expanding when the second volume contracts during relative movement of the piston and the cylinder; and means for attaching the movable contact to the piston-cylinder means so that relative movement of the piston and the cylinder moves the movable contact out of the first position toward the second position.

45. The device of claim 44, wherein the cylinder is stationary;

the piston is movable; and the attaching means attaches the movable contact to the piston for conjoint movement therewith.

46. The device of claim 44, wherein the cylinder is movable;

the piston is stationary; and the attaching means attaches the movable contact to the cylinder for conjoint movement therewith.

47. The device of claim 44, wherein the piston and the cylinder are both movable.

48. The device of claim 44, which further comprises a second conductive reservoir of pressurized dielectric fluid with a port for directing the fluid at a second arc within the housing;

a second movable contact which receives one end of the second arc;

a second diaphragm normally closing the second port;

second means for electrically connecting the second movable contact to the second reservoir when the second movable contact is in a first normal position and for receiving the other end of the second arc as the second movable contact moves away from the second reservoir toward a second position;

means for tearing the second diaphragm to open the second port in response to movement of the second movable contact out of the first position; and wherein one of the movable contacts being attached to the piston, the other movable contact being attached to the cylinder.

49. The device of claim 48, wherein the movable contacts move toward each other as they move toward their second positions.

50. The device of claim 49, wherein the piston-cylinder means further comprises power cartridge means for relatively moving the piston and the cylinder upon ignition thereof.

51. A high voltage circuit interrupter, comprising a housing carrying opposed terminals connectable to opposite sides of a circuit;

a conductive reservoir of pressurized dielectric fluid connected to one of the terminals and having a port through which the fluid flows;

a diaphragm normally closing the port;

a movable contact mechanically attached to the diaphragm and mounted for movement away from the reservoir to tear the diaphragm and to open the port;

means for electrically connecting the reservoir to the movable contact when the latter is attached to the diaphragm, and for receiving one end of an arc, the other end of which is received by the movable contact, when the movable contact moves;

piston-cylinder means, attached to the movable contact remotely from the diaphragm for moving the movable contact upon relative movement of a piston and a cylinder thereof, the piston-cylinder means being continuously electrically connected to the other terminal; and means for relatively moving the piston and the cylinder, movement of the movable contact tearing the diaphragm to permit fluid flow at the arc struck between the movable contact and the connecting means.

52. A housed high voltage circuit interrupter having opposed circuit-connectable terminals on the housing, the interrupter comprising a reservoir of pressurized dielectric fluid having a first contact electrically connected to one of the terminals and a port through which the fluid flows;

a diaphragm normally closing the port, and being electrically connected to the one terminal;

a second contact normally attached to the diaphragm and electrically connected to the first contact when so attached, the contacts being mounted for movement away from each other to tear the diaphragm, the first contact receiving one end of an arc, the other end of which is received by the second contact when it moves to break its electrical connection to the first contact, the arc being located so as to receive fluid flowing from the port;

means for moving the contacts to tear the diaphragm and to initiate fluid flow at the arc struck between the contacts; and means for continuously electrically connecting the second contact to the other terminal.

53. An improved circuit interrupting device of the type having a pair of relatively movable contacts which receive respective ends of an arc as they move apart, wherein the improvement comprises:

a reservoir of normally pressurized dielectric fluid with a port for directing the fluid at the arc;

removable means for normally closing the port; and means responsive to movement apart of the contacts for removing the closing means to open the port by applying thereto a removing force in the same general direction in which the fluid flows from the port.

54. A device according to claim 53, wherein the closing means comprises a diaphragm for normally closing the port; and the removing means comprises means for tearing the diaphragm.

55. A device according to claim 53, which further comprises force-responsive means for moving the contacts apart and for applying the removing force.

56. A device according to claim 55, wherein the force-responsive means includes a piston-cylinder.

57. A device according to claim 53, which further comprises force-generating means for moving the contacts apart and for applying the removing force.

58. A device according to claim 57, wherein the force-generating means includes a power cartridge.

59. A device according to claim 57, which further comprises force-responsive means for moving the contacts apart and for applying the removing force.

60. A device according to claim 59, wherein the force-generating means includes a power cartridge; and the force-responsive means includes a piston-cylinder.

61. An improved circuit interrupting device of the type in which a flow of dielectric fluid is directed at an arc established between a pair of parting contacts, wherein the improvement comprises:

diaphragm means for normally preventing flow of the fluid; and means for applying a tearing force to the diaphragm to permit fluid flow as the contacts part, the tearing force being applied in the same general direction as the fluid flows.

* * * * *